US008286574B2

(12) United States Patent
Müller

(10) Patent No.: US 8,286,574 B2
(45) Date of Patent: Oct. 16, 2012

(54) LOWERABLE PLATFORM WITH FLOAT FOR A WATERCRAFT

(76) Inventor: Peter A. Müller, Gattikon (CH)

( * ) Notice: Subject to any disclaimer, the term of this patent is extended or adjusted under 35 U.S.C. 154(b) by 535 days.

(21) Appl. No.: 12/526,865

(22) PCT Filed: Feb. 11, 2008

(86) PCT No.: PCT/CH2008/000050

§ 371 (c)(1),
(2), (4) Date: Aug. 12, 2009

(87) PCT Pub. No.: WO2008/098393

PCT Pub. Date: Aug. 21, 2008

(65) Prior Publication Data

US 2010/0089302 A1 Apr. 15, 2010

(30) Foreign Application Priority Data

Feb. 12, 2007 (CH) ..... 232/07

(51) Int. Cl.

| | |
|---|---|
| ***B63B 27/14*** | (2006.01) |
| ***B63B 17/00*** | (2006.01) |
| ***B63B 23/04*** | (2006.01) |
| ***B63B 23/30*** | (2006.01) |
| ***B63B 23/44*** | (2006.01) |
| ***B63B 27/36*** | (2006.01) |
| ***B63B 39/00*** | (2006.01) |

(52) U.S. Cl. ..... 114/362; 114/259; 114/343; 114/369

(58) Field of Classification Search ..... 114/44, 114/45, 48, 258, 259, 343, 362, 365, 368–374; 248/640–642; 405/1–3

See application file for complete search history.

(56) References Cited

U.S. PATENT DOCUMENTS

| | | | | |
|---|---|---|---|---|
| 3,075,490 | A | 1/1963 | Lang | |
| 4,271,553 | A * | 6/1981 | Korsvik | 114/373 |
| 4,657,513 | A | 4/1987 | Baker | |
| 4,861,299 | A * | 8/1989 | Ueberschaer | 441/80 |
| 5,613,462 | A | 3/1997 | Schwartz | |
| 6,152,065 | A * | 11/2000 | Gronstrand | 114/365 |
| 6,327,992 | B1 | 12/2001 | Martin | |
| 6,823,809 | B2 * | 11/2004 | Hey | 114/45 |
| 6,953,003 | B1 * | 10/2005 | Mulhern | 114/259 |
| 2001/0027740 | A1 | 10/2001 | Arias | |

FOREIGN PATENT DOCUMENTS

| | | | |
|---|---|---|---|
| DE | 91 03 949 | U1 | 7/1991 |
| DE | 196 02 331 | A1 | 7/1997 |
| EP | 0 253 745 | | 1/1988 |
| GB | 2 370 253 | A | 6/2002 |
| WO | WO 03/106254 | A | 12/2003 |
| WO | WO 2004022421 | A1 * | 3/2004 |

* cited by examiner

*Primary Examiner* — Ajay Vasudeva
(74) *Attorney, Agent, or Firm* — Henry Feiereisen, LLC

(57) ABSTRACT

The invention relates to a lowerable platform (1) for a water craft (10), which can be also horizontally extended and to which a float (2) is fastened that comprises a closed hollow space (43) or an open hollow space (43), a buoyancy (A) acting upon the float (2) being generated by the air volume (L). As a result, the water craft's proper weight or the payload (N) of e.g. a tender boar (27) on the lowerable platform (1) can be compensated by the buoyancy (A). A hydrodynamic design of the float (2) additionally generates a hydrodynamic buoyancy (D1) which can be varied in terms of its height in relation to the current (S) by means (4, 37, 38, 39), depending on the float (2).

23 Claims, 5 Drawing Sheets

LOWERABLE PLATFORM WITH FLOAT FOR A WATERCRAFT

TECHNICAL FIELD

The invention is directed to a lowerable platform with an integrated float for watercrafts, according to the preamble of the first claim.

STATE-OF-THE-ART

Lowerable platforms, in particular for swimmers, divers and tenders, are known in the art and described, for example, in the patents DE 196 02 331, US 2001/0027740 A1, or partially lowerable swimming pools with walkable surfaces, as described in the patent EP 0253745.

Also known are spacer-type fastening means with height adjustment for outboard motors on the stern of watercrafts, in order to attain by the height adjustment speed advantages, and to not take up space in the cockpit of the watercraft when the outboard motor is tilted upward, as described in the U.S. Pat. No. 3,075,490 or U.S. Pat. No. 4,657,513.

DESCRIPTION OF THE INVENTION

It is an object of the invention to attach on the stern of a watercraft a lowerable platform, also for applications with outboard motors, which also has buoyancy means for keeping the lowerable platform unaided above the water line, whereby the buoyancy means provide, at a corresponding speed of the watercraft, also hydrodynamic support, or can form a container for various technical means.

Lowerable platforms have a considerable tare weight and essentially include the deformation-resistant lowerable platform itself, pivoting arms, articulated joints, hydraulic cylinders and fastening components on the stern of the watercraft. A lowerable platform can be used to enhance the comfort for swimmers, divers, to get in and out of the water, or to relax on the platform and to just sit at the same level as the water line and be splashed by the water and/or for putting a tender or jet ski in the water, which can be parked and secured in dry condition on the lowerable platform when not in use.

Persons and the tender vehicle can weigh many times the tare weight of the lowerable platform, thus representing a large load for the stern structure of a watercraft. Such weight can also substantially change the trim of a watercraft, even at low speed, and many even cause the propeller of the bow thruster to partially rise above the surface, so that port maneuvers can no longer be effectively performed. The dynamic stresses in the stern region of a watercraft are also considerably greater when the watercraft is moving through waves and when at the same time a tender or jet ski is attached on the lowerable platform. The hydraulics must also be able to permanently absorb the full weight and the impact from the waves of the lowerable platform, possibly supported only by hooks and bolts which help to prevent the lowerable platform from becoming detached from the secured position.

The invention solves these problems by providing the lowerable platform with buoyancy means which help to absorb the tare weight or the weight of the useful load by way of the floats, thereby additionally improving the safety of the moving watercraft, supporting the trim of the watercraft and ensuring that the lowerable platform cannot be uncontrollably lowered, and that the fluid cylinders need not move large loads. The pivot arms can then have a much thinner and lighter shape.

Because the platform is lowered by about 0.6 to about 1.5 m below the water line, it is technically not difficult to provide the buoyancy means with technical means, such as trim flaps, steering rudder, underwater lights, exhaust gas piping, extendable stilts, transverse jet rudder and the like, and to route the hydraulic and electric lines accordingly. The buoyancy means can have openings, so that pivot levers can freely move therein and are protected from environmental harm, within the protection is provided also to the swimmers, because they cannot get caught in the mechanism of the pivot arms.

The buoyancy means can be constructed as one unit or made of modules and are suitably attached to the lowerable platform. To provide optimal buoyancy with respect to the tare weight and the weight of the useful load, variable hollow bodies can be provided in the buoyancy means, so that depending on the size of a hollow body, this can produce more or less buoyancy, so that positive weight balancing can be performed easily and accurately.

The height of the contact position of the platform on the stern can be limited, on one hand, by the mechanical properties of the pivot arm or the fluid cylinders or, on the other hand, with a mechanical limit stop placed between the platform and the rear wall of the watercraft. This limiting feature can be implemented by aligning the buoyancy means with the bottom of the watercraft hull so that they are subjected to the same flow, or by forming a corresponding step. Alternatively, limit stop on the platform or on the buoyancy means can be varied, while the watercraft is moving, depending on the speed of the watercraft, so that the buoyancy means are more or less wetted by the water flow.

In a particular application, the lowerable platform can be attached to a watercraft having an outboard motor. Such watercraft leave very little space behind the motors, because the motor must be pivoted upward when the propeller hits bottom or in the rest position, so that according to the invention a means, on which the lowerable platform is located, is interposed between the watercraft and the outboard motor, so that the lowerable platform can be lowered laterally. Such an embodiment would not be realistic without a float, because the watercraft could tilt strongly to the side when someone walks on the lowerable platform, in particular with the solution having an additional horizontal extension, which would compromise the safety and would be detrimental for a substantially tilt-free lowering of the platform.

This is attained with the invention with the features of the first claim.

The core idea of the invention is to reduce loading of a lowerable platform with respect to the stern of a watercraft, to safely maintain the position of the lowerable platform, to guarantee the trim and roll stability of the watercraft, in particular when applying a lowerable platform in conjunction with outboard motors, and to use the lowerable platform as means for simultaneously attaching various technical means in the stern region, as well as to improve the hydrodynamic properties of the watercraft, without requiring additional installation work on the stern of the watercraft.

Additional advantageous embodiments of the invention are recited in the dependent claims.

BRIEF DESCRIPTION OF THE DRAWINGS

Exemplary embodiments of the invention will be described hereinafter with reference to the drawings. Identical elements in the various figures have the same reference symbols.

Only the elements required for a fundamental understanding of the invention are schematically illustrated.

APPROACH FOR IMPLEMENTING THE INVENTION

Figure 1:
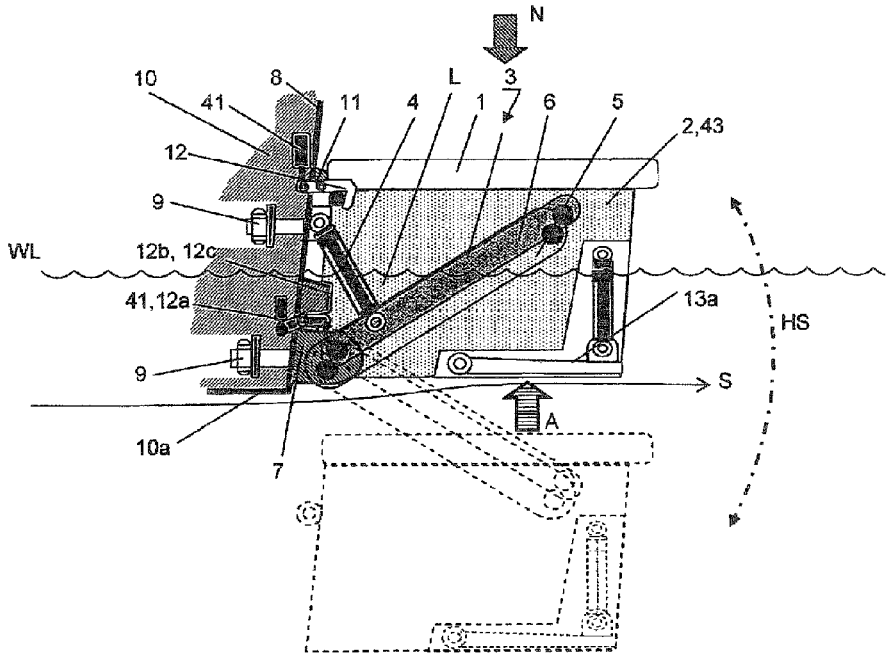
FIG. 1 shows schematically a side view of the lowerable platform with the float and integrated technical means, the lifting mechanism and a self-lock.

FIG. 1 shows schematically a side view of the lowerable platform 1 with the float 2 attached thereto, which is a watertight hollow body 43 illustrated with an air volume L and partially submerged, as illustrated by the waterline WL. However, the watertight hollow body 43 may also contain a water-repellent light foam with an equivalent air volume L. The lifting mechanism 3, consisting of a working cylinder 4 as well as a lower pivot arm 5 and an upper pivot arm 6—representing a parallelogram, whereby at least two parallelograms are mounted for each lowerable platform 1—and are attached accordingly on the lowerable platform 1 or on the float 2 and are connected on the opposite side to the stern 8 of the watercraft 10 by way of an articulated joint mount 7 with the screw connection 9.

The float 2 can also include various technical means 13, for example trim flaps 13*a*, underwater lighting, rudder elements and the like, wherein the technical means 13 are separated from the float 2 to prevent water from entering the hollow body 43 of the float 2. This is effectively accomplished by filling the hollow body 43 with foam.

The lift limiting means 11 have a large a surface as possible to avoid localized pressure exerted on to the stern 8, while simultaneously allowing adjustment of the upper contact position of the lowerable platform 1. The lowerable platform 1 is lowered, optionally below the water line WL, as indicated by the lifting/pivoting line HS, by activating the working cylinder 4 on the lifting mechanism 3.

Due to the buoyancy force A generated in the float 2, which is produced by the air volume L and corresponds to the static buoyancy D2, the lowerable platform 1 is not lowered by gravity, but is instead pushed into the lowering direction by the thrust force K1 of the working cylinder 4. This has the advantage that in the event of a failure of the hydraulic, the lowerable platform 1 is automatically raised by the buoyancy force A, so that the working cylinder 4 therefore never has to push the entire tare weight of the lowerable platform 1 and of the lifting mechanism 3. A self-lock 12 is attached on the stern 8, so that when the lowerable platform 1 is raised by the buoyancy force A to the lift limiting means 11, the platform 1 is automatically secured with the self-lock 12 in the contact position and the float 2 also smoothly fits the hull 10*a* for optimal flow S during travel. The self-lock 12 is released by activating the locking cylinder 41. The self-lock 12 is constructed to hold the position of the lowerable platform 1 even when the watercraft is moved to a dry dock.

If a tender boat 27 or people are on the platform 1 and if the useful load N is greater than the buoyancy force A, then the working cylinder 4 brakes the lowering of the platform and supports lifting the platform 1 with the useful load N by applying the pulling force K2.

The float 2 can also have a hydrodynamic shape, from which the watercraft 10 can benefit with respect to the stability, fuel consumption and the like. The float 2 can also have a float lock 12*a*, so that the lifting mechanism 3 is not subjected to uncontrolled forces from large hydrodynamic forces caused by the flow S; instead, the forces are already absorbed on the float 2, preferably in the lower region thereof. The float lock 12*a* can be passive, in that when the platform 1 contacts the stern 8, a formfitting coupling 12*b*, 12*c* of the float 2 with the stern 8 is produced, or active where a second self-lock 12 is used in conjunction with a locking cylinder 41 that can be unlocked.

Of course, the hydraulics which may be double-acting, can also be implemented pneumatically or with an electric spindle drive, and a linear rail system can be substituted for a parallelogram of the lifting/pivoting region HS.

Figure 2:
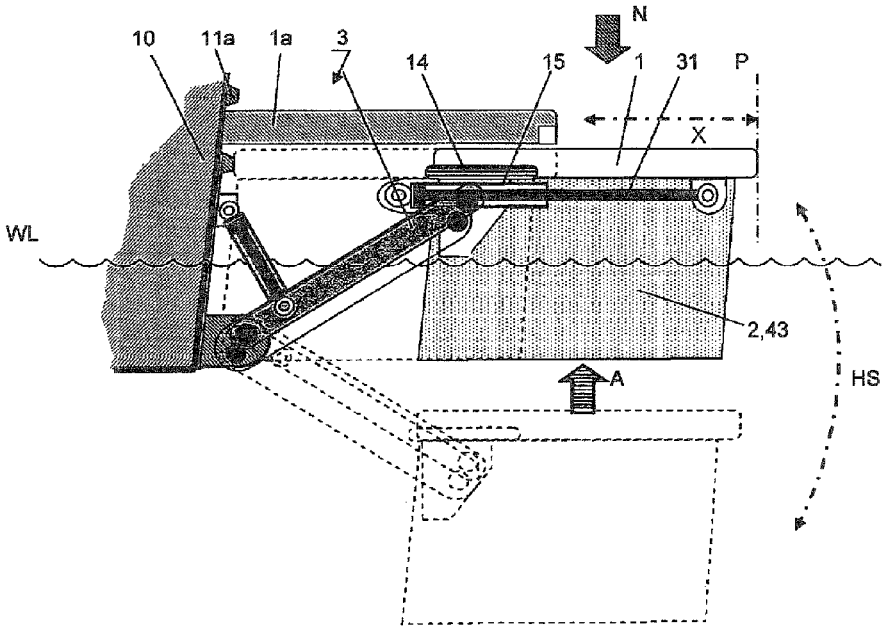
FIG. 2 shows schematically a side view of the lowerable platform with the float in a horizontally extended position and the lifting/sliding mechanism.

FIG. 2 shows schematically a side view of the lowerable platform 1, with the float 2 attached thereto, in the horizontally extended position P, indicated by the arrow X, which is achieved with a sliding mechanism 14 located under a second fixed upper platform 1*a*. The sliding mechanism 14 can be a slide rail or a rail/roller combination, so that the lowerable platform 1 can be moved back and forth horizontally on the lifting support 15. The horizontal displacement is performed either manually or with a horizontal working cylinder 31. The lifting support 15 can simultaneously also form a mount for the pivot arms 5, 6. When the lowerable platform 1 slides horizontally, the attached float 2 is moved by the buoyancy force A and therefore only slightly changes the trim of the watercraft 10, even when a tender boat is attached, as compared to a variant without floats 2.

The lifting support 15 can also be raised so that the lowerable platform 1 attains a position above a shortened upper platform 1*a*, and the lowerable platform 1 is moved, by way of un-illustrated openings in the floats 2, horizontally according to the arrow X to an upper lift limiting means 11*a*, where it can be placed on the upper platform 1*a*.

Figure 3:
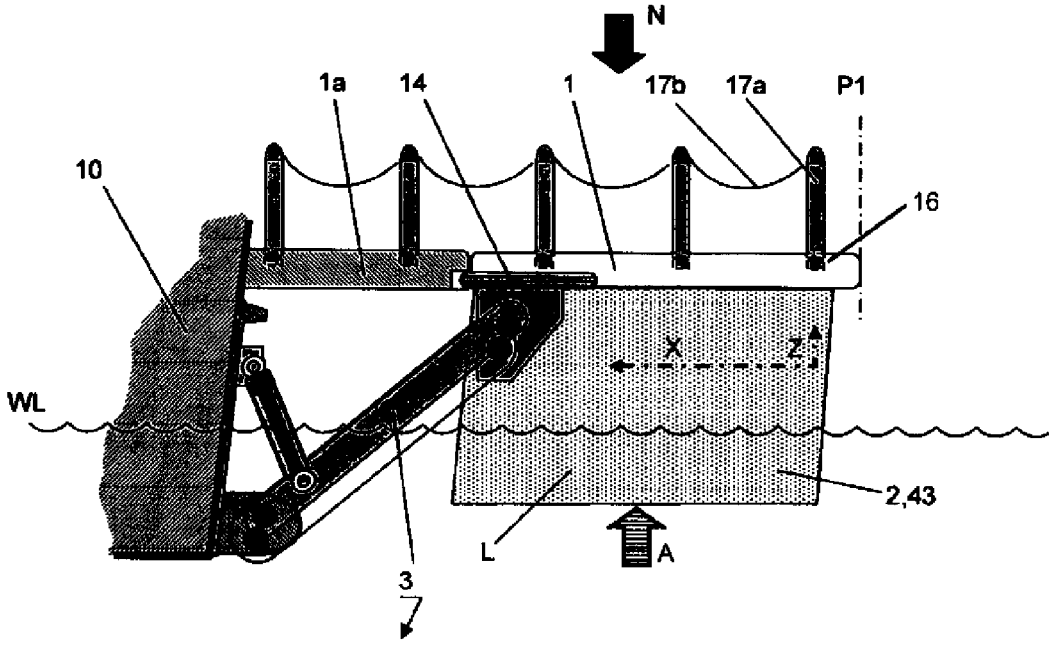
FIG. 3 shows schematically a side view of the lowerable platform with the float and the lifting/sliding mechanism in the horizontally extended and additionally raised position, as well as a barrier.

FIG. 3 shows schematically a side view of the lowerable platform 1 with the float 2 attached thereto in the horizontally extended and additionally raised lifting position P1, as indicated by the vertical arrow Z. By completely extending the lowerable platform 1 beyond the region of the upper platform 1*a*, the lift on the working cylinder 4 can be additionally raised, so that the lowerable platform 1 forms a plane with the upper platform 1*a*. In this way, a very large flat platform surface is attained, which can be used as an additional standing surface for persons and goods and which can provide sufficient buoyancy due to the float 2, so that the watercraft can does not become submerged in the stern region. To protect the persons and goods, insertion element 16, for example holes, are provided in the lowerable platforms 1, 1*a* for insertion of barrier elements 17, such as posts 17*a* with rope barriers 17*b*.

Figure 4:
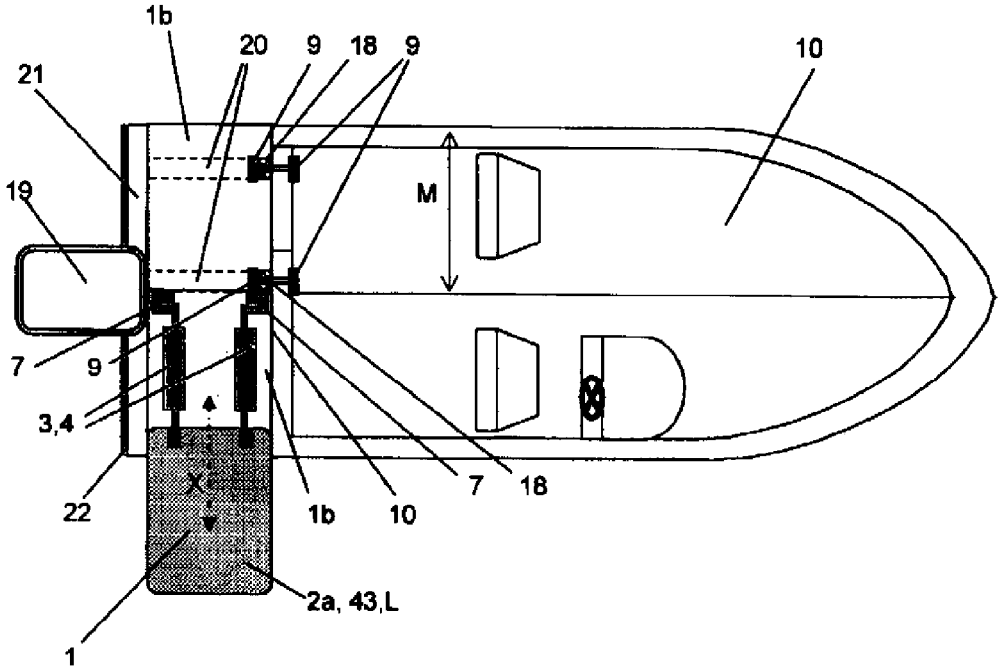
FIG. 4 shows schematically a top view of a watercraft with an outboard motor with laterally extendable and lowerable platform with a float attached thereto, in the laterally extended position.

FIG. 4 shows schematically a top view onto a watercraft 10 with an outboard motor 19 with laterally extendable and lowerable swim platform 1 having a float 2 attached thereto. One or more supports 20 which support a cross brace 21 and a freestanding transverse platform 1*b* are located on the stern 8, with the articulated joint mount 7 and the lifting mechanism 3 attached to one support 20, wherein the lifting mechanism 3 allows the lowerable platform 1 to be pivoted out transversal to the travel direction of the watercraft 10. The lowerable platform 1 can be positioned above or below the transverse platform 1*b*, or the transverse platform 1*b* covers only one half of the area between the cross brace 21 and the stern 8, indicated by the measure M, so that the lowerable platform 1 can operate without horizontal lift X and rotated directly into or out of the water. The cross brace 21 supports the outboard motor 19, or several, as well as the cover 22, so that a safe separation exists between the swimmer on the lowerable platform 1, the lifting mechanism 3 and the outboard motor 19, in particular the propeller of the outboard motor, also during high waves.

Damping means 18 for damping the vibrations from the outboard motor 19 can be interposed in the screw connection 9 between the support 20 and the stern 8, to prevent to the greatest extent possible a transmission of vibrations from the motor to the watercraft 10.

Figure 5:
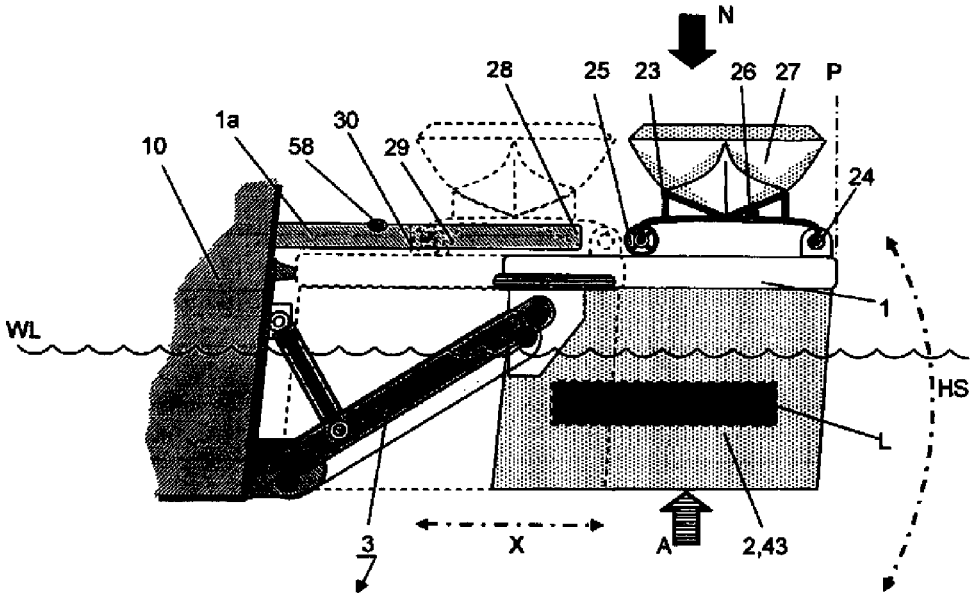
FIG. 5 shows schematically a side view of the lowerable platform with the float and the lifting/sliding mechanism in the horizontally extended position, with a tender boat mount.

FIG. 5 shows schematically a side view of the lowerable platform 1, with the float 2 attached thereto, in the horizontally extended position P, wherein the lowerable platform 1 have a tender mount 23, which is at one end fixedly connected with the lowerable platform 1 by way of an articulated joint 24 and which has at the other end a movable roller pair 25. The tender mount 23 can have a sensor 26 which informs the operator of the watercraft or the controller 38 if a tender boat 29 is located on the tender mount 23, or if it is properly positioned. The tender mount 23 can also have corresponding un-illustrated mounting devices for securely holding the tender boat 27 on the watercraft 10, as indicated by the mounting device sensor 58. If the tender boat 27 rests on the tender mount 23 and the lowerable platform is in the position P, then the buoyancy force A produced by the float 2 preferably fully compensates the useful load N on the lowerable platform. If the lowerable platform 1 is oriented horizontally with respect to the stern 8, then the tender mount 23 secured to the articulated joint 24 moves up the ramp 28 of the upper platform 1*a* on its roller pair 25, continues until shortly before the end of the horizontal movement, descends the second ramp 29 into the opening 30 having a corresponding hole dimension, so that the tender mount 23, or the roller pair 25, now again rests directly on the lowerable platform 1, thereby unloading the upper platform 1*a*.

Figure 6:
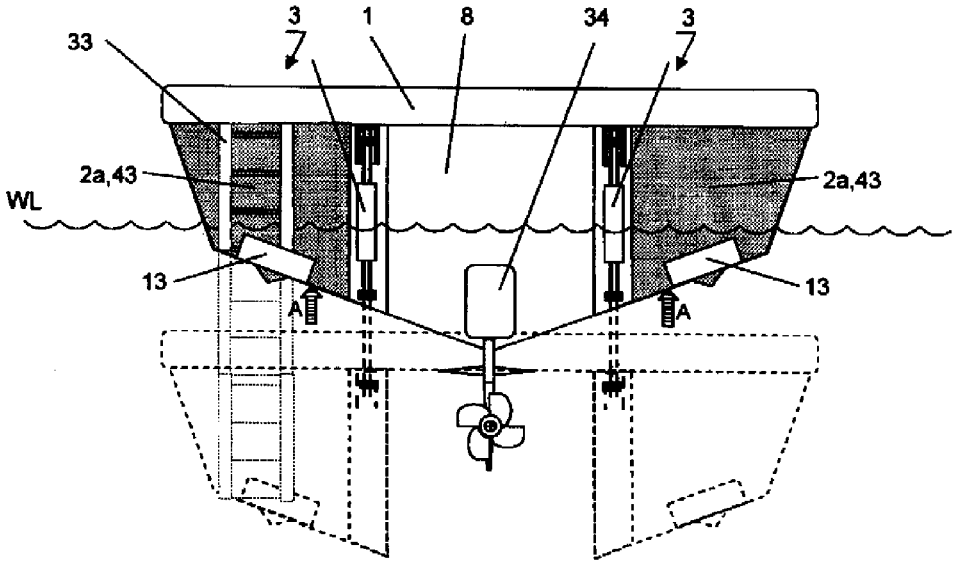
FIG. 6 shows schematically a stern view onto a watercraft with a lowerable platform with modular floats and integrated lifting mechanisms.

FIG. 6 shows schematically a stern view onto a stern 8 with a lowerable platform 1 with attached modular floats 2*a* and integrated lifting mechanisms 3. If an obstacle 34 is located on the stern 10, such as a Z-drive or an exit opening of a jet drive or the like, then it makes little sense to use a continuous float 2, but rather corresponding modules which can be quickly and easily installed individually on the lowerable platform 1. These modules can also perform hydrodynamic tasks and can also include technical means 13. Advantageously, watercrafts 10 can also have different widths, while the slope of the ship's bottom is mostly the same. For example, a certain modular float 2*a* with a slope of 19° can advantageously be attached to a watercraft 10 having a width of 3 m or 4 m, together with a suitable dimensioned lowerable platform 1.

Besides lowering the platform 1 below the water line (WL) and then raising it, it may be desirable to leave the platform 1, e.g., in a submerged position and have the swimmers instead use a swim ladder. For this purpose, a telescopable swim ladder 33 is provided which, on one hand, is rotatably attached to the stern 8 or the platform 1*a* and, on the other hand, is attached to the float 2, with the swim ladder 33 being shortened or extended according to the lift/pivot line.

Figure 7:
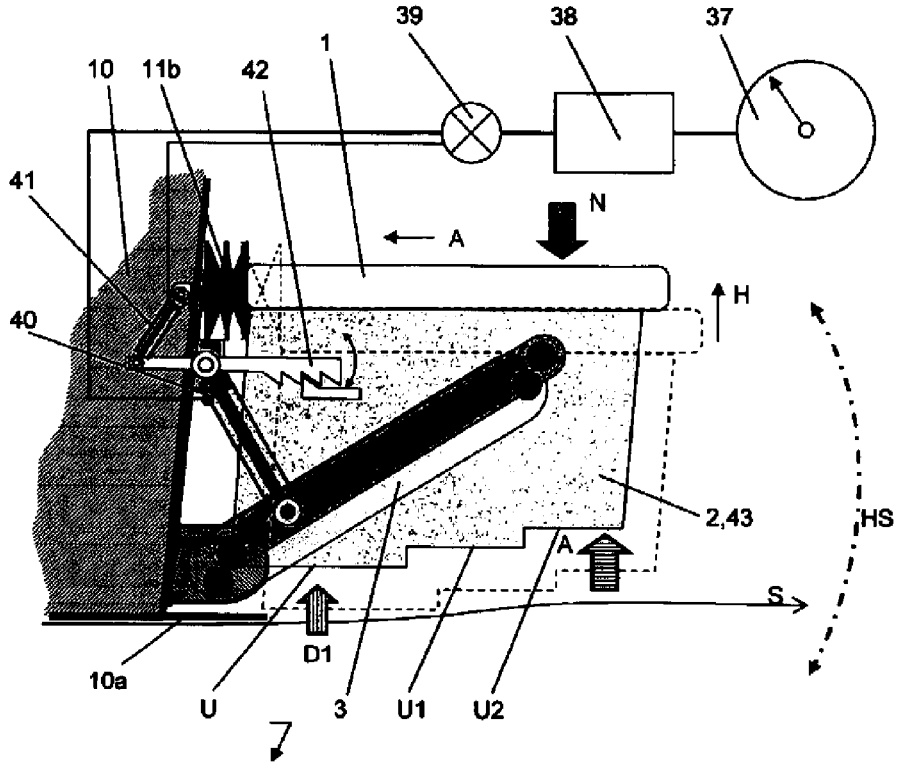
FIG. 7 shows schematically a side view of the lowerable platform with the float, with a movable mechanical height limit and lock, as well as a controller for the working cylinder by way of the rotation speed or speed of the watercraft.

FIG. 7 shows schematically a side view of the lowerable platform 1 with an attached float 2, wherein the lifting height of the float 2 is limited by a variable limiting means 11*b*, so that the bottom edge U of the float 2 is located in the water flow S, or alternatively is only partially wetted or can be completely moved out of the flow. The lift may also be limited by the working cylinder 4. The length of the watercraft can then be changed and, if desired, the submerged length of the hull 10*a* of the watercraft 10 can be shortened or lengthened the watercraft 10 by submerging the float 2 arranged on the lowerable platform 1. Tests on hydro-gliding watercrafts 10 have shown that it is advantageous up to a certain speed to have an additional hull length exposed to the water flow, because the additional hull length produces additional hydrodynamic buoyancy D1, whereas after further increase in speed, the friction on the additional hull length adversely affects efficiency. A measurement transducer 37 which records the rotation speed and the travel speed 37, respectively, can transmit a command to the hydraulic units 39 via a controller 38, to retract or extend the working cylinder 4, wherein the effective position is acknowledged by the position measuring sensor 40. When the working cylinder 4 is operated, the locking cylinder 41 is first unlocked to release the lock 42, which can be a toothed gear, allowing the float 2 to move freely. The lock 42 allows various fixed positions, so that the float 2 can be locked at each full lift position H, so that a watercraft can with the lowerable platform 1 can safely jump over waves.

A simpler way to affect the hull length of a sliding watercraft 10 as a function of speed is to install one or more step edges U1, U2 on the lower edge U of the float 2, because the faster a hydro-gliding watercraft 10 with V-shaped hull travels, the higher it lifts out of the water, so that it is desirable to further shorten or decrease the friction surface at the hull end.

Also contemplated is a solution wherein the lowerable platform 1 is not moved when adjusting the float (2), and wherein instead the variable lifting limit 11*b* is located between the platform 1 and the float 2, with un-illustrated variable spacers allowing a correct adjustment of the float 2. The height can also be varied manually or with hydraulic or electrical means.

Accordingly, there is always a buoyancy A on the float 2. When the watercraft 8 is at rest, the float 2 produces a static buoyancy D2. When the speed of the watercraft 8 increases, then the static buoyancy D2 is reduced and dynamic buoyancy D1 is created. The two types of buoyancy, either the first or the second type or the combination, are combined here to form the buoyancy A.

Figure 8:
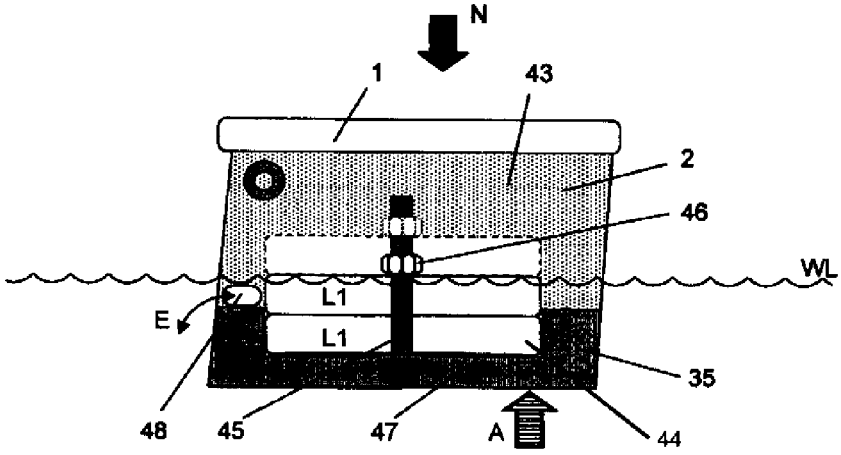
FIG. 8 shows schematically a side view on a float with integrated stackable hollow bodies.

FIG. 8 shows schematically a side view on a lowerable platform 1 with an attached float 2 having a basic fill level 35 integrated in a hollow space 43, as well as stackable hollow bodies 44 each having an air volume L1, which are secured on the bottom section 47 of the float 2 by using, for example, a threaded rod 45 and a nut 46. Instead of using air in the hollow bodies 44, these can also be filled with foam. The opening 48 allows the hollow body 43 to be filled with water or to be drained, as illustrated by the arrow E. The boatyard or the ship's owner can thereby balance the buoyancy A on the float 2 and accurately set a positive, neutral or negative total buoyancy with respect to the tare weight or with respect to the additional useful load, and accurately adjust the desired value.

Figure 9:
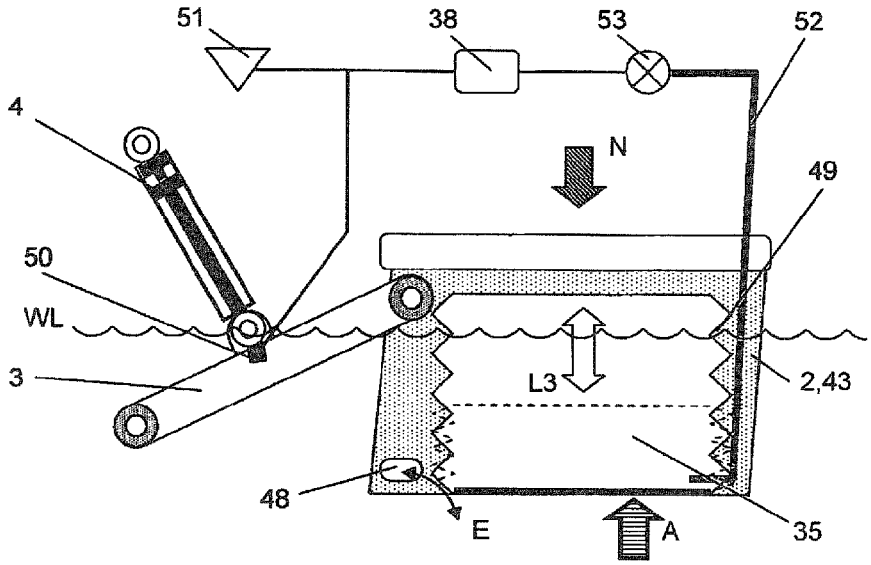
FIG. 9 shows schematically a side view on a float with adjustable volume of the hollow body, manually or automatically via sensors.

FIG. 9 shows schematically a side view on a float 2 with an adjustable hollow body 49 integrated in the hollow space 43, for example in form of a bellow, wherein the air volume L2 in the bellow can be varied manually or automatically with a pressure sensor 50 or a tender sensor 51. The volume is increased or decreased through the line 52 using an air pump 53. Automatic filling or venting is triggered by a pressure sensor 50 which measures the forces at the pivot arm 4 or 5, wherein the measured pressure value is transmitted to the controller 38, which in turn transmits the command to the air pump 53 and changes the volume in the adjustable hollow body 49 until the pressure sensor 50 indicates the desired value. The same applies to the tender sensor 51, which measures a predetermined weight of a tender boat 27 via the sensor 26 and thereby controls the effective useful load N by blowing into or venting from the adjustable hollow body 49 a corresponding air volume L. By increasing or decreasing the volume of the adjustable hollow body 49, the hollow space 43 is filled through the opening 48 with more or less water, thereby varying the buoyancy, while always maintaining a basic fill level 35, and hence a basic buoyancy A.

Instead of air, any medium lighter than water can be selected.

Figure 10:
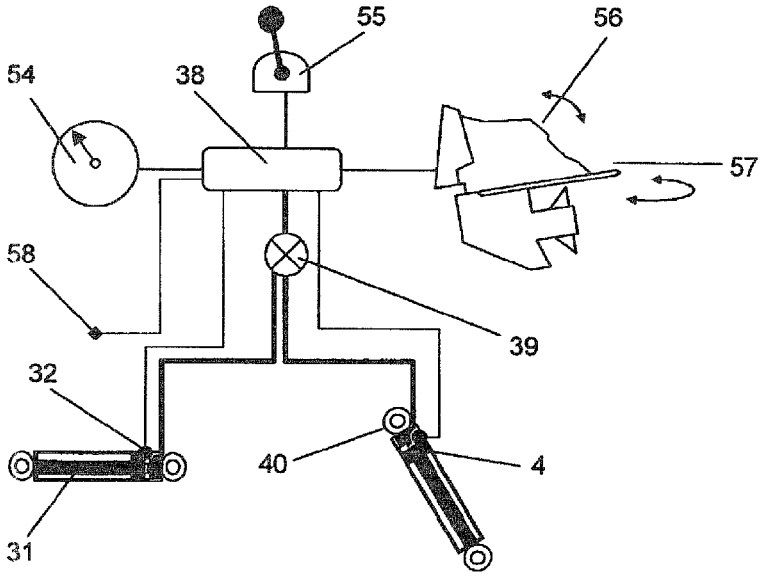
FIG. 10 is a schematic diagram of the working cylinder control based on the sensors, lift position, rotation speed, gear position and Z-drive position.

FIG. 10 is a schematic diagram of the control of the working cylinder 4 with the controller 38 based on the various sensors 32, 40, 54, 55, 56, 57, 58, such as the horizontal lift measurement sensors 32 of the horizontal working cylinder 31, travel position 40 of the working cylinder 4, rotation speed level 54, gear position 55, Z-drive position 56, 57, with the latter subdivided in turn position 56 and excursion position 57, as well as mounting device sensor 58 and travel position sensor 32 of the horizontal working cylinder 31. For safety reasons, the watercraft 10 should not be operated with the platform 1 lowered, so that the transmission is locked when the engine is operating, so as to prevent travel, or only slow travel is permitted by limiting the rotation speed of the engine. If the tender boat 27 is still mounted on the tender mount 23, or on the lowerable platform 1, as indicated by the mounting device sensor 58, then the lowerable platform 1 cannot be lowered past a predetermined lift value. The lowerable platform 1 should also not be extended beyond a predetermined value, as long as to the obstacle 34, for example the trim position 56 and the excursion position 57 of the Z-drive, are not with in a predetermined position field, because the housing of the Z-drive could otherwise damage the lowerable platform 1.

It will be understood that the invention is not limited to the illustrated and described exemplary embodiments.

LIST OF REFERENCE SYMBOLS

1 lowerable platform
1*a* upper platform
1*b* transverse platform
2 float
2*a* modular float
3 lifting mechanism
4 working cylinder
5 lower pivot arm
6 upper pivot arm
7 articulated joint mount
8 stern
9 screw connection
10 watercraft
10*a* watercraft hull
11 lift limiting means
11*a* upper limiting means
11*b* variable limiting means
12 self-lock
12*a* float lock
12*b* coupling element 1
12*c* coupling element 2
13 technical means
13*a* trim flaps
14 slider mechanism
15 lifting support
16 insertion elements
17*a* post
17*b* rope barrier
18 damping means
19 outboard motor
20 support
21 cross brace
22 cover
23 tender mount
24 articulated joint
25 roller pair
26 sensor
27 tender boat
28 ramp
29 second ramp
30 opening
31 horizontal working cylinder
32 horizontal lift measurement sensor
33 swim ladder
34 obstacle
35 basic fill level
36 propeller
37 measurement sensor
38 controller
39 hydraulic unit
40 distance sensor
41 locking cylinder
42 lock
43 hollow space
44 hollow body
45 threaded rod
46 nut
47 bottom part
48 opening
49 adjustable hollow body
50 pressure sensor
51 tender sensor
52 supply line
53 air pump unit
54 rotation speed level
55 gear position
56 Z-drive trim position
57 Z-drive excursion position
58 mounting device sensor
40, 54, 55, 56, 57, 58 sensors
WL waterline
HS lift/pivot line
A buoyancy
D1 hydrodynamic buoyancy
D2 static buoyancy L air volume
L1 air volume stackable
L2 air volume variable
X horizontal lift
Z raised lift
P extended position
E water exchange
H lift position
S (water) flow
U bottom edge
U1, U2 stepped edge
N useful load
M dimension transversal platform small

The invention claimed is:

1. A lowerable platform for a watercraft, comprising:

a float attached below the platform, wherein the float has a hydrodynamic shape and includes one or more stepped edges and generates a buoyancy force which holds the platform above a water line, and a working cylinder arranged between a stern area of the watercraft and the lowerable platform and providing a thrust force for lowering the platform below the water line, wherein the float has a closed hollow space or an open hollow space with a predetermined basic buoyancy, wherein the closed hollow space contains air with an air volume or water-repellent light foam with an equivalent air volume, or the open hollow space contains attachable hollow bodies with an air volume or adjustable hollow bodies with a variable air volume, and an air pump supplying air to the air volume, either under manual control or under control by a controller, for compensating the buoyancy force.

2. Lowerable platform according to claim 1, wherein against a useful load acting on the platform, which is greater than the buoyancy force, the working cylinder generates a pulling force in order to slow down the platform during the lowering operation or lifting the platform.

3. Lowerable platform according to claim 1, wherein the platform without the effect of the working cylinder and without a high useful load, the platform is automatically raised above the water line by the buoyancy force acting on the float and is automatically locked on a stern of the watercraft or on a support by way of the self-look.

4. Lowerable platform according to claim 1, further comprising a lifting mechanism having at least one parallelogram or at least one linear rail for varying the height of the platform relative to the watercraft without tilt, wherein the parallelogram has a lower pivot arm and an upper pivot arm.

5. Lowerable platform according to claim 1, wherein the float at a stern area of the watercraft produces a static buoyancy at rest, and a dynamic buoyancy while traveling.

6. Lowerable platform according to claim 1, wherein the lowerable platform with the attached float is lowered transversal to the direction of travel of the watercraft.

7. Lowerable platform according to claim 6, wherein a support has a cross brace which is used as fastening means for an outboard motor as well as for a cover and for support for a transverse platform, with a lifting mechanism attached to the cross brace.

8. Lowerable platform according to claim 7, wherein damping means are mounted between the support and a stern of the watercraft.

9. Lowerable platform according to claim 1, further comprising a lifting mechanism having a sliding mechanism, so that the lowerable platform with the attached floats can be moved horizontally or laterally.

10. Lowerable platform according to claim 1, further comprising a swim ladder pivotally mounted on the lowerable platform with a first end, wherein the swim ladder can be telescoped, while a second end of the swim ladder is pivotally connected on the stern area.

11. Lowerable platform according to according to claim 1, wherein the float comprises technical means.

12. Lowerable platform according to claim 1, further comprising a lift limiting means or a variable lift limiting means, which supported against the lowerable platform or the float, being located at the stern area, so that a lower edge of the float can be adjusted with respect to the flow and can accommodate static buoyancy forces and hydrodynamic buoyancy forces.

13. Lowerable platform according to claim 1, further comprising a lift limiting means or a variable lift limiting means, which is supported against the lowerable platform or the float, being located on the platform, so that a lower edge of the float can be adjusted with respect to the flow and can accommodate the static buoyancy forces and the hydrodynamic buoyancy forces.

14. Lowerable platform according to claim 1, further comprising a releasable lock being attached on the float which allows the float to be fixed in one or more positions.

15. Lowerable platform according to claim 1, further comprising a coupling element being disposed on the float and a complimentary coupling element being disposed on the stern area, wherein the coupling elements can be coupled.

16. Lowerable platform according to claim 1, further comprising a float lock being arranged between the float and the stern area, which can be coupled together, and a locking cylinder for unlocking the float from the stern.

17. Lowerable platform according to claim 1, wherein instead of the air as a buoyancy medium, any other medium can be used that is lighter than water.

18. Lowerable platform according to claim 1, wherein the float covers a lifting mechanism.

19. Lowerable platform according to claim 1, wherein the float is a module.

20. A lowerable platform for a watercraft, comprising:

a float attached below the platform, wherein the float has a hydrodynamic shape and includes one or more stepped edges and generates a buoyancy force which holds the platform above a water line, a working cylinder arranged between a stern area of the watercraft and the lowerable platform and providing a thrust force for lowering the platform below the water line, a stationary upper platform located above the lowerable platform in a retracted position of the lowerable platform and constructed to be movable into an tended position laterally in a horizontal direction and upward by a sliding mechanism and a horizontal working cylinder and by operating the working cylinder to form one plane with the lowerable platform, wherein the lowerable platform comprises a tender mount which is connected at one end to the lowerable platform with articulated joints and is supported with another end on the lowerable platform by a roller pair, wherein the upper platform comprises ramps facing the tender mount and an opening, allowing the tender mount to move onto the upper platform in an identical direction as the lowerable platform when the lowerable platform is moved from the extended position to the retracted position.

21. Lowerable platform according to claim 20, further comprising insertion elements for barrier elements located on the upper platform and the lowerable platform.

22. A lowerable platform for a watercraft, comprising:

a float attached below the platform, wherein the float has a hydrodynamic shape and includes one or more stepped edges and generates a buoyancy force which holds the platform above a water line, a working cylinder arranged between a stern area of the watercraft and the lowerable platform and providing a thrust force for lowering the platform below the water line, a measurement sensor disposed on the float, wherein the measurement sensor measures as a measurement value the RPM of an outboard motor or of a propeller or the speed of the watercraft, and transmits the measurement value to a controller which according to a program activates a hydraulic unit, in such that the working cylinder causes the lowerable platform with the attached float to lift, in order that a lower edge of the float is wetted in the water flow, either completely or partially or not at all, thereby producing a variable hydrodynamic buoyancy.

23. Lowerable platform according to claim 22, wherein activation of the working cylinder by the controller and the hydraulic unit depends on the sensor.

* * * * *